US010082788B1

(12) United States Patent
Dengel et al.

(10) Patent No.: US 10,082,788 B1
(45) Date of Patent: Sep. 25, 2018

(54) JOYSTICK ASSEMBLY AND SYSTEM FOR CONTROLLING STEERING AND THRUST OF A MARINE PROPULSION DEVICE

(71) Applicant: Brunswick Corporation, Lake Forest, IL (US)

(72) Inventors: Michael P. Dengel, Malone, WI (US); Lance W. Ziemer, Van Dyne, WI (US); Steven J. Gonring, Slinger, WI (US)

(73) Assignee: Brunswick Corporation, Mettawa, IL (US)

( * ) Notice: Subject to any disclaimer, the term of this patent is extended or adjusted under 35 U.S.C. 154(b) by 47 days.

(21) Appl. No.: 15/492,188

(22) Filed: Apr. 20, 2017

(51) Int. Cl.
*G05D 1/00* (2006.01)
*B63H 25/02* (2006.01)

(52) U.S. Cl.
CPC ..... *G05D 1/0016* (2013.01); *B63H 25/02* (2013.01); *B63H 2025/026* (2013.01)

(58) Field of Classification Search
CPC . G05D 1/0016; B63H 25/02; B63H 2025/026
See application file for complete search history.

(56) References Cited

U.S. PATENT DOCUMENTS

| | | | |
|---|---|---|---|
| 4,614,900 | A | 9/1986 | Young |
| 4,946,411 | A | 8/1990 | Novey |
| 5,481,261 | A | 1/1996 | Kanno |
| 5,741,166 | A | 4/1998 | Newman |
| 6,054,831 | A | 4/2000 | Moore et al. |
| 6,144,367 | A | 11/2000 | Berstis |
| 6,264,513 | B1 | 7/2001 | Marsh |
| 6,273,771 | B1 | 8/2001 | Buckley et al. |
| 6,655,309 | B1 | 12/2003 | Stephens |

(Continued)

FOREIGN PATENT DOCUMENTS

| | | | |
|---|---|---|---|
| WO | 1993023286 | A1 | 11/1993 |
| WO | 2002085702 | A1 | 10/2002 |

OTHER PUBLICATIONS

Poirier et al., "Systems and Methods for Controlling a Marine Vessel Having a Joystick with Adjustable Display", Unpublished U.S. Appl. No. 14/830,988, filed Aug. 20, 2015.

(Continued)

*Primary Examiner* — Calvin Cheung
(74) *Attorney, Agent, or Firm* — Andrus Intellectual Property Law, LLP

(57) ABSTRACT

A system for controlling steering and thrust of a marine vessel's propulsion device includes a joystick assembly providing input signals to a control module. The joystick assembly includes a docking station at the helm; a first electrical connector in the docking station cable-connected to the control module; a detachable base for coupling with the docking station; a handle moveable within the detachable base to generate the input signals; a second, complementary electrical connector in the detachable base; and a wireless transmitter mounted in the detachable base. A wireless receiver communicates with the transmitter and the control module. When the detachable base is coupled to the docking station and the electrical connectors are mated, the cable transmits input signals to the control module. When the detachable base is removed from the docking station and the electrical connectors are disconnected, the wireless transmitter and receiver transmit input signals to the control module.

20 Claims, 6 Drawing Sheets

(56) References Cited

U.S. PATENT DOCUMENTS

| | | | |
|---|---|---|---|
| 7,104,212 | B2 | 9/2006 | Brianza |
| 7,127,333 | B2 | 10/2006 | Arvidsson |
| 7,267,068 | B2 | 9/2007 | Bradley et al. |
| 7,927,216 | B2 | 4/2011 | Ikeda et al. |
| 2015/0034001 | A1 | 2/2015 | Clarke et al. |

OTHER PUBLICATIONS

Dannenberg et al., "Joystick", Unpublished U.S. Appl. No. 29/536,884, filed Aug. 20, 2015.
Vaninetti et al., "Joystick with Top Display", Unpublished U.S. Appl. No. 29/536,885, filed Aug. 20, 2015.
Abellera et al., "Animated Responsive Display on a Joystick", Unpublished U.S. Appl. No. 29/536,886, filed Aug. 20, 2015.
Abellera et al., "Illuminated Responsive Display on a Joystick", Unpublished U.S. Appl. No. 29/536,888, filed Aug. 20, 2015.
Arbuckle et al, "Vessel Maneuvering Methods and Systems", Unpublished U.S. Appl. No. 15/437,233, filed Feb. 20, 2017.
Arbuckle et al., "Station Keeping Methods", Unpublished U.S. Appl. No. 15/445,031, filed Feb. 28, 2017.
Ward et al, "Methods for Controlling Movement of a Marine Vessel Near an Object", Unpublished U.S. Appl. No. 15/246,681, filed Aug. 25, 2016.
Mercury Marine, "Axius Generation 2 Installation Manual", manual, Jul. 2010, pp. 6-7.
Berton, Gerald, "'Dual Band' and 'Fusion' Yacht Controller", web article, 2014, last accessed Mar. 22, 2017, available at http://www.yachtcontroller.com/dualband.

JOYSTICK ASSEMBLY AND SYSTEM FOR CONTROLLING STEERING AND THRUST OF A MARINE PROPULSION DEVICE

FIELD

The present disclosure relates to systems for controlling steering and thrust of marine propulsion devices on marine vessels, and more specifically, to joystick assemblies for generating and sending input signals to a control module that controls such steering and thrust.

BACKGROUND

U.S. Pat. No. 6,273,771, which is incorporated by reference herein, discloses a control system for a marine vessel that incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 7,267,068, which is incorporated by reference herein, discloses a marine vessel that is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

Unpublished U.S. patent application Ser. No. 14/830,988, filed Aug. 20, 2015, which is incorporated by reference herein, discloses a joystick device for controlling propulsion and steering of a marine vessel having a handle configured to be moveable by an operator to provide propulsion and steering control commands for a marine vessel, and a housing at the base of the handle such that the handle extends out of the housing. The joystick device also has an adjustable display thereon that adjusts based on at least one of a control mode and a movement of the handle.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a system for controlling steering and thrust of a marine propulsion device on a marine vessel includes a control module in signal communication with the marine propulsion device and a joystick assembly in signal communication with the control module and providing input signals to the control module. The joystick assembly comprises a docking station configured to be coupled to a helm of the vessel; a first electrical connector mounted in the docking station and connected to the control module by at least one cable; a detachable base configured to couple with the docking station; a handle supported by the detachable base and moveable with respect to the detachable base to generate the input signals; a second electrical connector, complementary to the first electrical connector, mounted in the detachable base; and a wireless transmitter mounted in the detachable base. A wireless receiver is provided in signal communication with the wireless transmitter and with the control module. In response to the second electrical connector being mated with the first electrical connector when the detachable base is coupled to the docking station, the input signals are transmitted to the control module via the at least one cable. In response to the second electrical connector being disconnected from the first electrical connector when the detachable base is removed from the docking station, the input signals are transmitted to the control module via the wireless transmitter and the wireless receiver.

According to another example of the present disclosure, a joystick assembly for generating and sending input signals to a control module that controls steering and thrust of a marine propulsion device on a marine vessel is disclosed. The joystick assembly comprises a docking station configured to be coupled to a helm of the vessel; a first electrical connector mounted in the docking station and connected to the control module by at least one cable; a detachable base configured to couple with the docking station; a handle supported by the detachable base and moveable with respect to the detachable base to generate the input signals; a second electrical connector, complementary to the first electrical connector, mounted in the detachable base; a wireless transmitter mounted in the detachable base; and a wireless receiver mounted in the docking station and in signal communication with the wireless transmitter and with the control module. In response to the second electrical connector being mated with the first electrical connector when the detachable base is coupled to the docking station, the input signals are transmitted to the control module via the at least one cable. In response to the second electrical connector being disconnected from the first electrical connector when the detachable base is removed from the docking station, the input signals are transmitted to the control module via the wireless transceiver and the wireless receiver.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
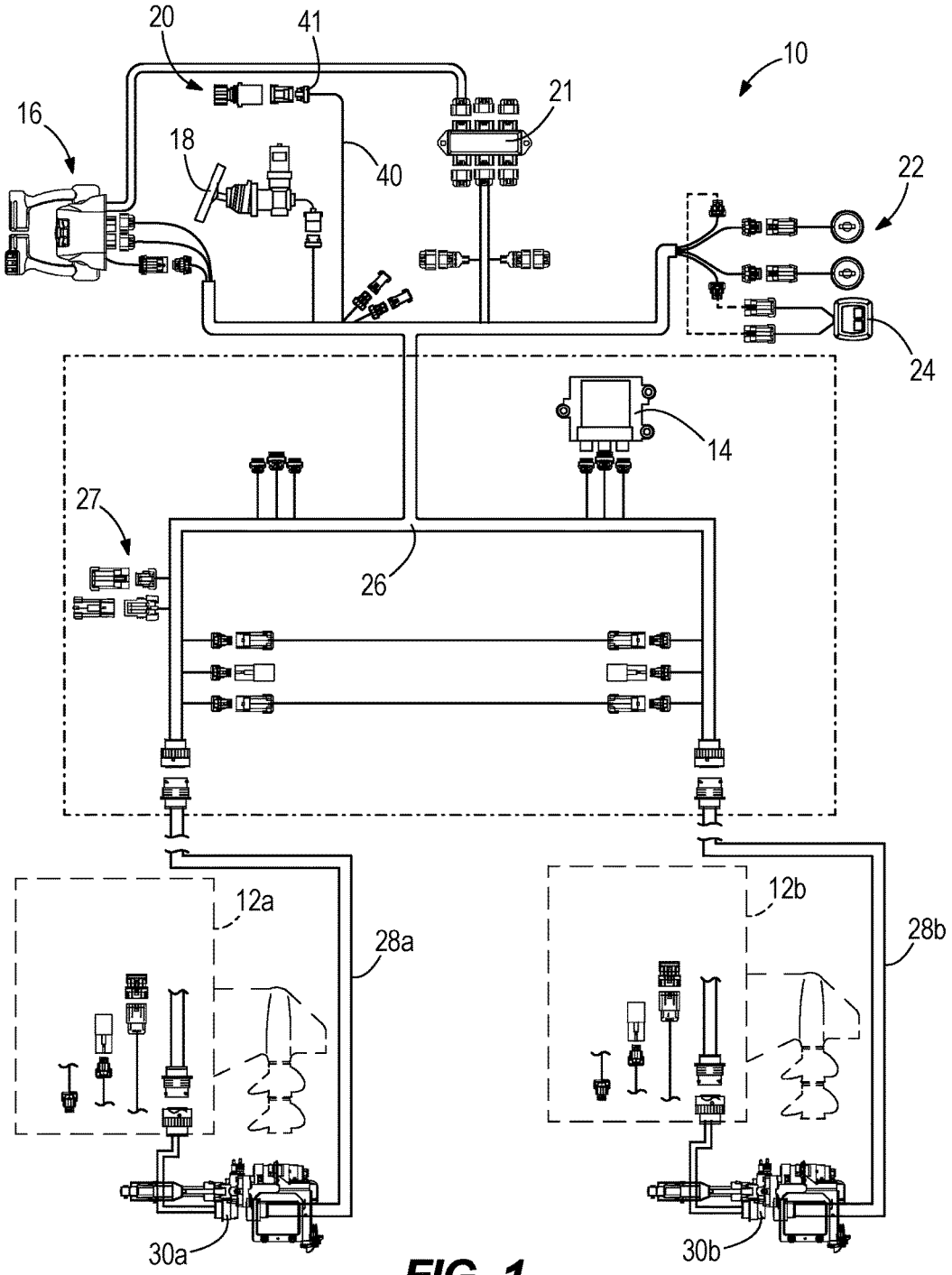
FIG. 1 is a schematic of a system for controlling steering and thrust of a marine propulsion device.

FIG. 1 is a schematic illustrating a system 10 for controlling steering and thrust of a marine propulsion device on a marine vessel. Specifically, the system 10 shown herein may be used to control two marine propulsion devices 12*a*, 12*b*, such as the pod drives shown herein. The propulsion devices may alternatively be outboard motors, stern drives, jet drives, or other types of steerable drives. In another example, only one propulsion device is provided. The system 10 also includes a control module 14 in signal communication with the marine propulsion devices 12*a*, 12*b*. The control module 14 is programmable and includes a processor and a memory. The control module 14 can be located anywhere in the system 10 and/or located remote from the system 10 and can communicate with various components of the marine vessel via a peripheral interface and wired and/or wireless links, as will be explained further herein below. Although FIG. 1 shows one control module 14, the system 10 can include more than one control module. Portions of the method disclosed herein below can be carried out by a single control module or by several separate control modules. For example, the system can have control modules located at or near a helm of the marine vessel and can also have control module(s) located at or near the propulsion devices 12*a*, 12*b*. If more than one control module is provided, each can control operation of a specific device or sub-system on the marine vessel. For example, separate control modules, herein referred to as thrust vector modules (TVM) may be provided for each of the propulsion devices, 12*a*, 12*b*, such as shown at 30*a*, 30*b*.

In some examples, the control module 14 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions of the system 10.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The system 10 includes an electronic remote control 16, which has throttle/shift levers for controlling speed and shift of the propulsion devices 12*a*, 12*b*. The system 10 also includes a steering wheel 18 which can be used to change the steering angles of the propulsion devices 12*a*, 12*b*. As an alternative to steering commands being sent from the steering wheel 18 and throttle and shift commands being sent from the electronic remote control 16, a joystick assembly 20 could be used to control steering and thrust of the marine propulsion devices 12*a*, 12*b*. How the joysticking mode can be initiated and how the joystick assembly 20 functions to send input signals to the control module 14 to control steering and thrust of the propulsion devices 12*a*, 12*b* is described more fully in U.S. Pat. No. 7,267,068, which was incorporated by reference above, and will not be described further herein. However, a specific configuration for the joystick assembly 20 according to the present disclosure will be described further herein below. A six-way junction box 21 allows for connection of components such as an inertial measurement unit (IMU), including a compass, a global positioning system (GPS) receiver, and other types of special-function input devices available for controlling the marine vessel, some of which will also be described further herein below. Key switches 22 and a dual engine start/stop switch 24 can be used to turn on, start, and stop engines powering the propulsion devices 12*a*, 12*b*.

The control module 14 communicates with one or more components of the system 10, including the electronic remote control 16, the steering wheel 18, the joystick assembly 20, components connected to the junction box 21, the key switches 22, the start/stop switch 24, and the propulsion devices 12*a*, 12*b*, via the I/O interfaces and a communication link, which can be a wired or wireless link. The control module 14 is capable of monitoring and controlling one or more operational characteristics of the system 10 and its various subsystems by sending and receiving control signals via the communication link. In the present example, the communication link is a controller area network (CAN) bus 26, and connections are made via cables. For example, the propulsion devices 12*a*, 12*b* can be connected to the CAN bus 26 aboard the vessel by way of 14-pin data harnesses 28*a*, 28*b*. However, connections for any or all of these devices could alternatively be wireless connections or other types of wired links. It should also be noted that the extent of connections of the communication link shown herein is for schematic purposes only, and the communication link in fact provides communication between the control module 14 and each of the peripheral devices noted herein, although not every connection is shown in the drawing for purposes of clarity.

Figure 2:
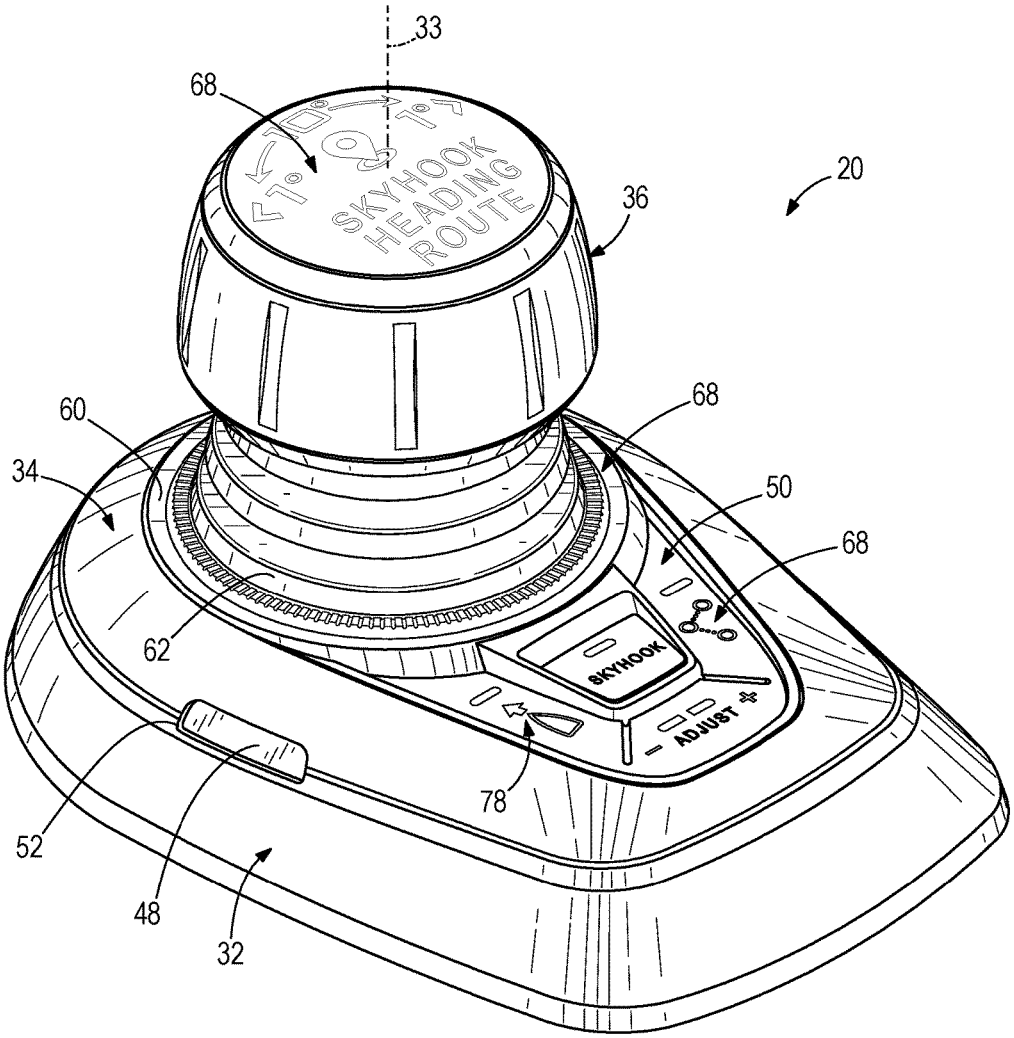
FIG. 2 illustrates one example of a joystick assembly according to the present disclosure.

FIG. 2 illustrates one example of the joystick assembly 20 of the present disclosure. The joystick assembly 20 includes a docking station 32 configured to be coupled to a helm 80 of a marine vessel 82 (see FIG. 6). The joystick assembly 20 also includes a detachable base 34 configured to couple with the docking station 32. A handle 36 is supported by the detachable base 34 and is movable with respect to the detachable base 34 to generate input signals, which the control module 14 uses to control steering and thrust of the propulsion devices 12*a*, 12*b*. For example, the handle 36 is rotatable about an axis 33 running through the center of the handle 36 and generally perpendicular to the detachable base 34 when the handle 36 is in an upright detent position. Rotation of the handle 36 about this axis 33 will cause the vessel 82 to yaw. The handle 36 is also tiltable in all directions away from the upright detent position, as shown herein, which tilting will cause the vessel 82 to move forward and back, side to side, or diagonally, with or without yaw, depending on whether the handle 36 is also rotated about the axis 33. The input signals are generated by relative movement between an inner base of the handle 36 and sensors within the detachable base 34, such as potentiometers, Hall Effect sensors, inductive sensors, or optical sensors.

Figure 3:
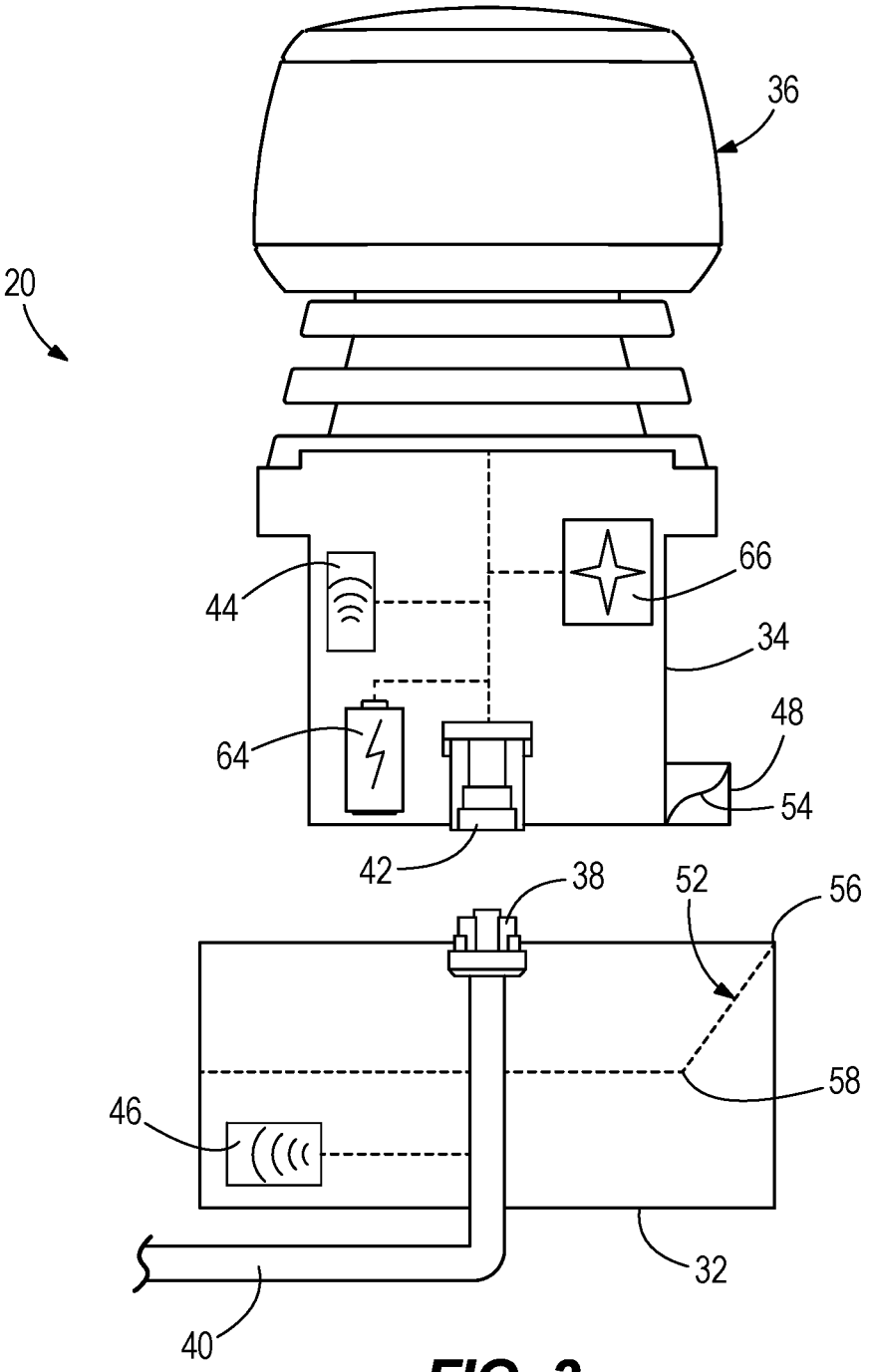
FIG. 3 is a schematic of the joystick assembly of FIG. 2.

FIG. 3 shows a simplified schematic of a rear view of the joystick assembly 20, including the detachable base 34 and the docking station 32. In this view, the detachable base 34 is "undocked" or disconnected from the docking station 32. A first electrical connector 38 is shown mounted in the docking station 32. The first electrical connector 38 is connected to the control module 14 by at least one cable 40 (see also FIG. 1). The detachable base 34 is shown in partial cross section in order to depict a second electrical connector 42, which is complimentary to the first electrical connector 38, and which is mounted in the detachable base 34. In one example, the first electrical connector 38 is a male electrical connector, and the second electrical connector 42 is a female connector, although the male/female identity of the first and second electrical connectors 38, 42 could be reversed. Additionally, although the first electrical connector 38 is shown as projecting from above a top surface of the docking station 32, it should be understood that the first electrical connector 38 could also be nested within the docking station 32 and not visible from a side view thereof. A similar description applies to the second electrical connector 42, which, although it is shown as being nested within the detachable base 34, could instead stick out wholly or partially from a bottom surface of the detachable base 34.

According to the present disclosure, a wireless transmitter 44 is mounted in the detachable base 34. A wireless receiver 46 is also provided and is in signal communication with the wireless transmitter 44. The wireless receiver 46 is also in signal communication with the control module 14, for example via the cable 40. In the present example, the wireless receiver 46 is mounted in the docking station 32. However, the wireless receiver 46 could instead be provided anywhere on the vessel 82 and/or as part of the control module 14. Note that in other examples, the wireless transmitter 44 and wireless receiver 46 could both be transceivers, capable of both transmission and receipt of wireless signals. The devices, whether transmitters, receivers, or transceivers, can operate using RFID, Bluetooth, cellular, infrared, Wi-Fi, or any other wireless technology capable of transmission for more than a meter or so. The detachable base 34 is sized and shaped to couple with the docking station 32 and to be held therein on the helm 80 of the vessel 82. When the detachable base 34 is docked in the docking station 32, the first and second electrical connectors 38, 42, because they are complimentary, are mated with one another.

Figure 4:
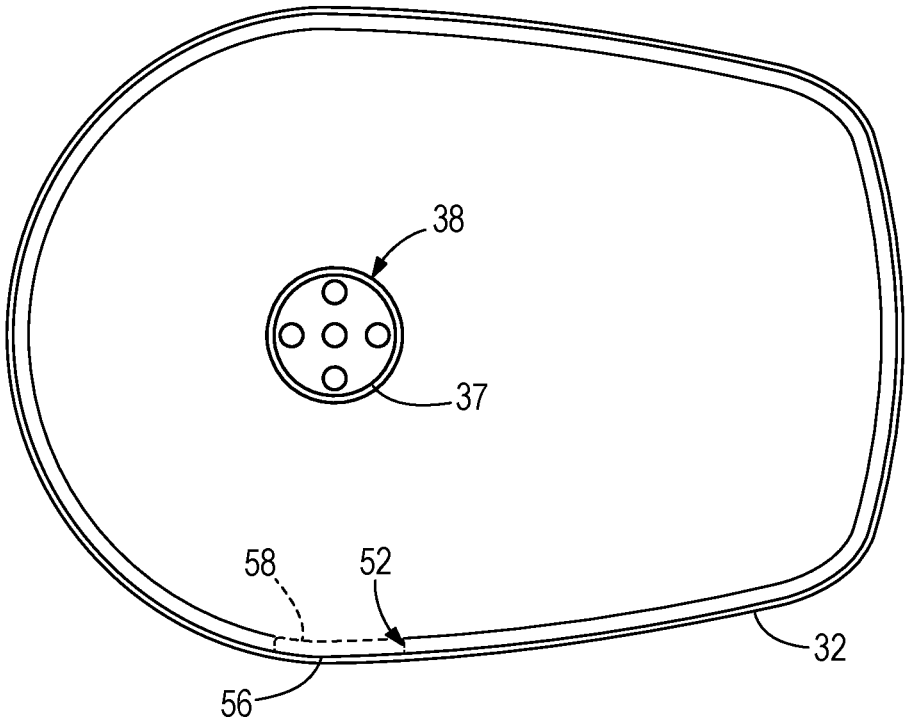
FIG. 4 shows a top view of a portion of the joystick assembly of FIG. 2.
Figure 5:
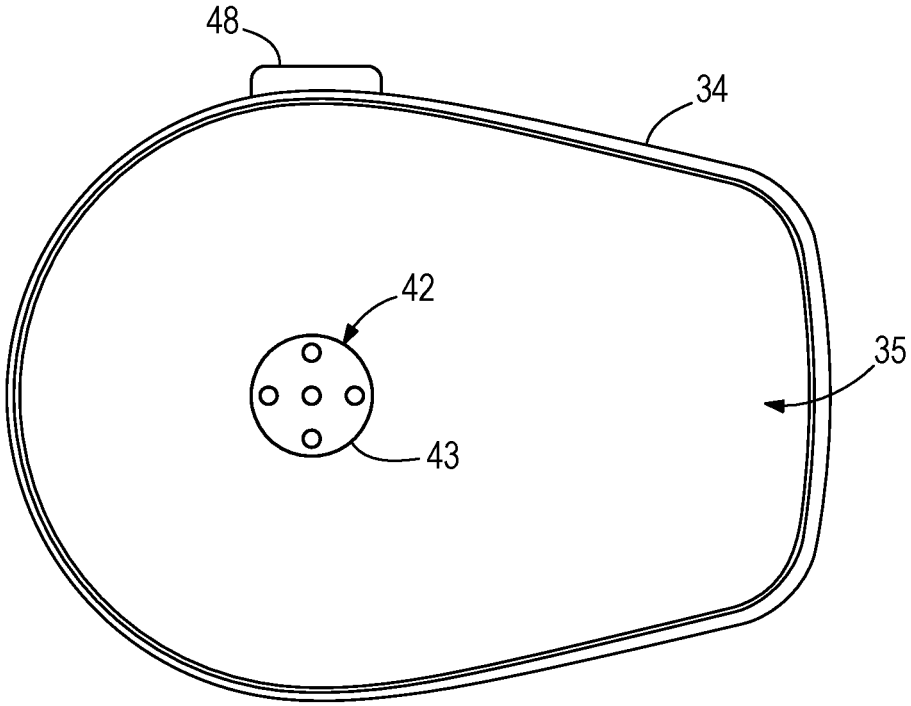
FIG. 5 shows a bottom view of a portion of the joystick assembly of FIG. 2.

FIGS. 4 and 5 show the first and second electrical connectors 38, 42 as being 5-pin device net connectors, but fewer or more pins could be provided depending on the number of electrical connections required to be made. The first and second electrical connectors 38, 42 may be provided with an O-ring seal 37 and a complimentary sealed socket 43, respectively, to insure a tight, waterproof fit between the two.

According to the present disclosure, in response to the second electrical connector 42 being mated with the first electrical connector 38 when the detachable base 34 is coupled to the docking station 32, the input signals, for example generated by movement of the handle 36, are transmitted to the control module 14 via the at least one cable 40. In other words, the joystick assembly 20 behaves as a hardwired joystick when the detachable base 34 is coupled with the docking station 32. However, in response to the second electrical connector 42 being disconnected from the first electrical connector 38 when the detachable base 34 is removed from the docking station 32, the input signals are transmitted to the control module 14 via the wireless transmitter 44 and the wireless receiver 46. This allows the detachable base 34 of the joystick assembly 20, including the handle 36, to be removed from the docking station 32, which is mounted to the vessel's helm 80, and carried around the vessel 82 by the operator. In both configurations, i.e. docked and undocked, the joystick assembly 20 is in signal communication with the control module 14 and provides input signals to the control module 14. The main difference between the two configurations is whether such input signals are transferred via the cable 40 (i.e., are transferred via a completely hardwired connection) or are transmitted at least in part wirelessly (i.e., by way of the wireless transmitter 44 and the wireless receiver 46).

Referring to FIGS. 2-5, the joystick assembly 20 further includes a feature that prevents unintended movement of the handle 36 from causing unintended movement of the propulsion devices 12*a*, 12*b* when the detachable base 34 is disconnected from the docking station 32. For example, in the embodiment shown herein, the detachable base 34 of the joystick assembly 20 includes a deadman switch 48 on its side, near its lower end. Note that the deadman switch 48 could instead be provided on the side or top of the handle 36 or on the underside 35 (FIG. 5) of the detachable base 34. According to the programming and/or wiring of the detachable base 34 and/or docking station 32, the joystick input signals, such as caused by movement of the handle 36, are not transmitted to the control module 14 unless the deadman switch 48 is depressed. Such prevention of the input signals from being transmitted to the control module 14 can be accomplished by preventing the wireless transmitter 44 from sending signals to the wireless receiver 46 when the deadman switch 48 is not depressed. Alternatively, such prevention of the input signals from being transmitted to the control module 14 can be accomplished by preventing the wireless receiver 46 from sending data to the control module 14. In an alternative embodiment, even when the deadman switch 48 is not depressed, input signals are transmitted to the control module 14, but the control module 14 ignores the input signals unless the deadman switch 48 is depressed.

The deadman switch 48 may be biased into a non-depressed state by a spring 54 (FIG. 3). The spring 54 may be a coil spring, a leaf spring, or any other type of spring known to those having skill in the art. While the detachable base 34 is removed from the docking station 32, the operator of the joystick assembly 20 may simply depress the deadman switch 48 with his thumb or other finger before manipulating the joystick handle 36 to generate the input signals, which are then sent to the control module 14 for controlling the propulsion devices 12*a*, 12*b*. Note that the joystick assembly 20 may also include various buttons 50 on the detachable base 34. These buttons 50 may also be used to generate input signals for the control module 14. If the deadman switch 48 is not depressed when one of the buttons 50 is pushed, the input signals may not be transmitted to the control module 14, or the control module 14 might ignore the input signals. In another embodiment, even if the deadman switch 48 is not depressed, input signals generated in response to actuation of the buttons 50 may still be acted upon by the control module 14. This is because it is less likely that the buttons 50 will be actuated upon dropping or bumping of the detachable base 34 than it is the joystick handle 36 would be actuated upon dropping or bumping of the detachable base 34.

When the detachable base 34 is coupled to the docking station 32, the operator will likely not desire to have to depress the deadman switch 48 while operating the joystick, although such an embodiment is included in the scope of the present disclosure. Rather, the docking station 32 of the joystick assembly 20 comprises a sloped slot 52 that is shaped to receive and depress the deadman switch 48 while the detachable base 34 is coupled to the docking station 32. Referring to FIG. 3, when the deadman switch 48 first comes into contact with an upper end 56 of the sloped slot 52, pressure exerted by the operator begins to compress the spring 54 as the deadman switch 48 begins to be depressed against the surface of the sloped slot 52. The detachable base 34 can then be pushed further downwardly into the docking station 32, and the deadman switch 48 further depressed by the slope of the slot 52, until the deadman switch 48 is in a fully depressed state when it reaches a bottom end 58 of the sloped slot 52. The spring 54 is held in its compressed state by the shape of the sloped slot 52, and the control module 14 sees the detachable base 34 as being in the same condition as if the deadman switch 48 were depressed by the operator. Thus, input signals are transmitted from the detachable base 34 to the control module 14, which thereafter acts on the input signals to control the propulsion devices 12*a*, 12*b*. When the detachable base 34 is removed from the docking station 32, the sloped slot 52 no longer holds the spring 54 in a compressed state. The spring 54 therefore returns to its rest position, and pushes the deadman switch 48 radially away from the outer wall of the detachable base 34. Until the deadman switch 48 is depressed by the operator, the detachable base 34 cannot be used to control the propulsion devices 12*a*, 12*b*.

Referring back to FIG. 2, the detachable base 34 of the joystick assembly 20 may also include an indicator 68 that provides different indications in response to certain conditions being true or not true. Here, the indicator may be in the form of an illuminable ring 60, which is a circular light display that surrounds the base 62 of the joystick handle 36. The illuminable ring 60 may be illuminated in its entirety, or portions of the illuminable ring 60 may be illuminated. For example, the illuminable ring 60 may blink, provide a trailing light around the circumference in a clockwise or counter-clockwise direction, or may otherwise provide an illumination pattern that indicates a particular mode, receipt of a control demand, or to present a control option. Furthermore, the illuminable ring 60 may be illuminated in one or more different colors, which may further be employed to convey information about a control mode, control commands, and/or control options. For example, in the embodiment described herein, the illuminable ring 60 may be illuminated in a particular color and/or pattern that uniquely indicates that the wireless transmitter 44 is operational and the deadman switch 48 is depressed. Such unique color and/or pattern of the illuminable ring 60 constitutes a first indication that is generated in response to the wireless transmitter 44 being operational and the deadman switch 48 being depressed. Note that other indicators 68 exist on the detachable base 34 and/or the handle 36, which could instead be lit up to provide the indication.

In another example, the deadman switch 48 need not be depressed in order for the first indication to be generated, but only the wireless transmitter 44 need be operational. Further, the indicator, such as the illuminable ring 60, may provide a second, different indication in response to the wireless transmitter 44 not being operational or the deadman switch 48 not being depressed. For example, the illuminable ring 60 may be a different color or may be illuminated in a different pattern when either of the above-mentioned conditions is not true. In another example, the illuminable ring 60 is not illuminated at all when the wireless transmitter 44 is not operational or the deadman switch 48 is not depressed. The indicator, such as the illuminable ring 60, therefore provides to the operator indications of whether the joystick handle 36 and/or buttons 50 may be used to send input signals to the control module 14 to control the propulsion devices. In yet another example, the indicator may provide a third indication, which may be different from the first and second indications or the same as the first indication, when the detachable base 34 is correctly plugged into the docking station 32. If this third indication does not appear, the operator will know he or she needs to adjust the position of the detachable base 34 in order to correctly mate the first and second electrical connectors 38, 42 and/or to adequately depress the deadman switch 48 within the sloped slot 52.

Returning to FIG. 3, the detachable base 34 of the joystick assembly may include other features, such as a rechargeable battery 64 and a directional sensor 66. The rechargeable battery 64 may be electrically connected to the second electrical connector 42, such that when the first and second electrical connectors 38, 42 are mated upon coupling of the detachable base 34 with the docking station 32, the rechargeable battery 64 is connected to a power supply. For example, the rechargeable battery 64 may be connected via the first and second electrical connectors 38, 42, and via the cable 40 to the CAN bus 26 and thereby to a battery by way of a power connection 27 (FIG. 1). The indicator, such as the illuminable ring 60, may be used to indicate to the operator that the joystick assembly 20 is low on batteries, is charging, or is fully charged, by way of fourth, fifth, and/or sixth indications. FIG. 3 also shows that the detachable base 34 of the joystick assembly 20 includes the directional sensor 66 in communication with the wireless transmitter 44. The directional sensor 66 could be a compass such as a MEMS (micro electro mechanical or micro electronic and micro electro mechanical systems) compass, which can be mounted on a circuit board. The directional sensor 66 determines an orientation of the detachable base 34, and the wireless transmitter 44 sends the orientation of the detachable base 34 to the control module 14, such as for example via the wireless receiver 46 and the cable 40, for comparison with an orientation of the vessel 82, such as that determined by the vessel's orientation sensor 70, as will be described below.

Figure 6:
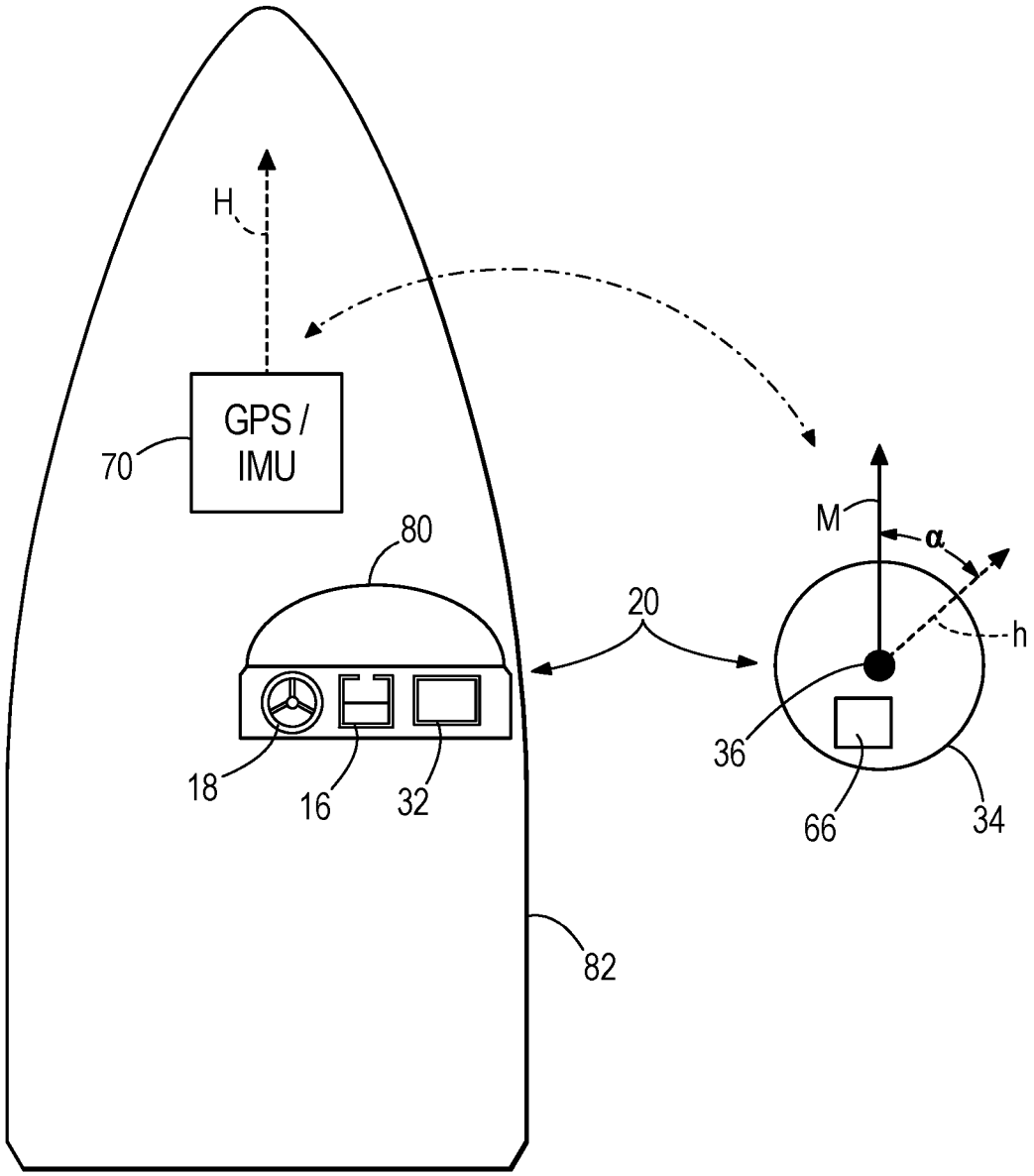
FIG. 6 is used to illustrate the concept of an orientation of a joystick assembly with respect to an orientation of a marine vessel.

Because the detachable base 34 of the joystick assembly 20 can be removed from the docking station 32 and carried about the vessel 82, the operator of the joystick assembly 20 will not have an immediate reference regarding what direction of motion of the joystick handle 36 will result in what direction of motion of the propulsion devices 12*a*, 12*b*, and therefore of the vessel 82. This may be especially true if the detachable base 34 is symmetrical, such as shown in FIG. 6. FIG. 6 shows an example of the detachable base 34 of the joystick assembly 20 versus an orientation of the marine vessel 82, which may be equipped with the joystick assembly 20. Although the detachable base 34 is shown as being removed from the vessel 82, it should be understood that the detachable base 34 could be held by an operator of the vessel 82, who is physically on board the vessel 82 while controlling its movement. The vessel 82 includes an orientation sensor 70, such as the combined GPS receiver and IMU shown herein. In another example, the orientation sensor 70 provided on the vessel 82 may be a compass or an attitude and heading reference system. The vessel's orientation sensor 70 provides a reading or an orientation (heading) of the vessel 82 with respect to due north, shown here by the dashed line arrow H In this example, the vessel's heading H=0°, and the vessel 82 is therefore oriented due north. In contrast, the detachable base 34 of the joystick assembly 20 has been rotated in a clockwise direction with respect to an orientation it would otherwise have were the detachable base 34 to be coupled to the docking station 32 on the vessel 82. In this example, the directional sensor 66 in the detachable base 34 of the joystick assembly 20 indicates that the detachable base 34 is rotated at an angle $\alpha$ from due north in the clockwise direction, and has a heading of h. The difference between the readings of the orientation sensor 70 on the vessel 82 and the directional sensor 66 on the detachable base 34 is therefore the $H-h=\alpha$. The control module 14 can use this offset angle $\alpha$ as a correction factor, such that no matter which way the detachable base 34 of the joystick assembly 20 is oriented, movement of the joystick handle 36 in a given direction with respect to due north will result in movement of the vessel 82 in that same given direction with respect to due north.

Figure 7:
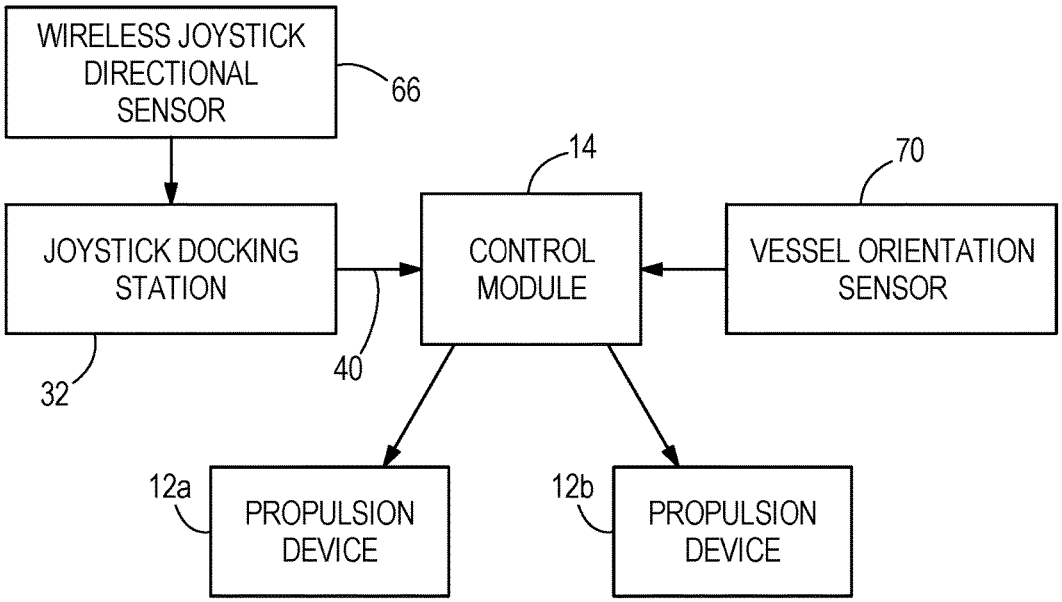
FIG. 7 schematically shows communications between various components of the system of FIG. 1.

Referring also to FIG. 7, the wireless joystick directional sensor 66 will transmit a signal regarding its heading to the joystick docking station 32 via the wireless transmitter 44. The docking station 32 will thereafter transmit this directional signal via the cable 40 to the control module 14. Meanwhile, the vessel orientation sensor 70 will also transmit a signal related to a heading of the vessel 82 to the control module 14. The control module 14 then calculates the difference between the directional readings from the vessel orientation sensor 70 and the wireless joystick directional sensor 66. The control module 14 thereafter offsets the input signals from the detachable base 34 of the joystick assembly 20 by the calculated difference between the two directional readings. The control module 14 then commands the propulsion devices 12*a*, 12*b* to move the vessel 82 in the direction the joystick handle 36 was physically moved. Therefore, the control module 14 is programmed to use the difference or offset in the headings/orientations of the detachable base 34 and the vessel 82 as a correction factor so that no matter which way the detachable base 34 is pointing, movement of the joystick handle 36 will cause aligned movement of the vessel 82. In other words, if the joystick handle 36 is moved due north as indicated by the solid line arrow M, the vessel 82 will move straight forward, although technically the joystick input signal would have corresponded to a forward-left diagonal movement without the offset.

In an alternative example described with respect to FIG. 2, the detachable base 34 of the joystick assembly 20 may be provided with a diagram of a boat or other type of indication such as an arrow, as shown at 78, which would indicate to the operator what direction of movement of the joystick handle 36 would result in what direction of movement of the vessel 82. This option would be an alternative to the above-noted orientation comparison and offset algorithm, and if the operator moved the joystick handle 36 forwards along the direction of arrow h (FIG. 6) while the detachable base 34 was rotated at the angle $\alpha$ with respect to the orientation of the vessel 82, the vessel 82 would move in the forward direction along arrow H. Accordingly, movement of the joystick handle 36 along the arrow M would result in forward-left movement of the vessel 82.

Figure 8:
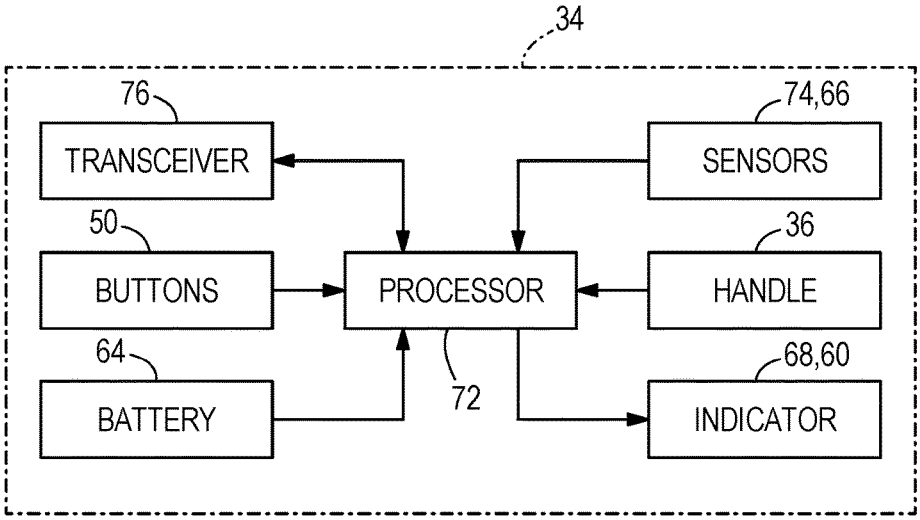
FIG. 8 is a schematic illustrating a portion of the joystick assembly according to the present disclosure.

FIG. 8 shows an example of the architecture of the detachable base 34 of the joystick assembly 20, in schematic form. Here, the detachable base 34 includes the above-noted joystick handle 36, the above-noted indicator 68, such as the illuminable ring 60, the above-noted buttons 50, and the above-noted battery 64. Each of these components is in signal communication with a processor 72. The processor 72 is further in communication with sensors 74, which take physical inputs from the joystick handle 36 and buttons 50 and output control signals to the processor 72. The processor 72 thereafter sends these control signals, in the form of input signals, to a transceiver 76, which thereafter transmits the input signals to the docking station 32, for receipt by the wireless receiver 46. Note that instead of the transceiver 76 shown herein, the wireless transmitter 44 could instead be provided. The directional sensor 66 could also be one of the sensors in communication with the processor 72.

In the above-described examples, the control module 14 did not act upon input signals from the wireless receiver 46 when the detachable base 34 was coupled to the docking station 32 and the second electrical connector 42 was mated with the first electrical connector 38. Rather, data was transmitted via a hardwired connection, such as via the first and second electrical connectors 38, 42 and the cable 40. In another example, however, the wireless transmitter 44 and wireless receiver 46 are always active, even when the detachable base 34 is coupled to the docking station 32. The directional sensor 66 could then be used to correct for any misalignment of the joystick assembly 20 during installation, such as if the joystick assembly 20 was not mounted perfectly parallel with the centerline of the vessel 82 during installation. The hardwired connection via the cable 40 could then be used as a backup in the event the wireless transmitter 44 or wireless receiver 46 is not operational.

Note that in the present example, the joystick assembly 20 comprises the only joystick configured to communicate with the control module 14. In other words, the joystick assembly 20 is not a second joystick assembly, provided in addition to a joystick that is permanently attached to the main helm 80. Rather, the joystick assembly 20 is the only form of joystick-like input device provided on the vessel 82, and is the detachable configuration shown and described. This is helpful on smaller boats, which have correspondingly small main helms, and therefore do not have room for an additional station on the main helm 80 for a second, remote joystick. Even if a helm on a smaller boat does have surface room for an additional remote joystick station, installation of such a second joystick might be difficult in terms of connections required underneath the helm. The joystick assembly 20 disclosed herein could be mounted to the main helm 80 at the very same location as a non-detachable joystick would have been located (or was located, in case of a retrofit), and the docking station 32 can be coupled to the CAN bus 26 by way of the very same connector 41 and cable 40 (FIG. 1) as the non-detachable joystick would have been (was) coupled to the CAN bus 26, and therefore does not require any separate wiring.

In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A system for controlling steering and thrust of a marine propulsion device on a marine vessel, the system comprising:

a control module in signal communication with the marine propulsion device;

a joystick assembly in signal communication with the control module and providing input signals to the control module, the joystick assembly comprising:

a docking station configured to be coupled to a helm of the vessel;

a first electrical connector mounted in the docking station and connected to the control module by at least one cable;

a detachable base configured to couple with the docking station;

a handle supported by the detachable base and moveable with respect to the detachable base to generate the input signals;

a second electrical connector, complementary to the first electrical connector, mounted in the detachable base; and a wireless transmitter mounted in the detachable base; and a wireless receiver in signal communication with the wireless transmitter and with the control module;

wherein, in response to the second electrical connector being mated with the first electrical connector when the detachable base is coupled to the docking station, the input signals are transmitted to the control module via the at least one cable; and wherein, in response to the second electrical connector being disconnected from the first electrical connector when the detachable base is removed from the docking station, the input signals are transmitted to the control module via the wireless transmitter and the wireless receiver.

2. The system of claim 1, wherein the detachable base of the joystick assembly further comprises a deadman switch, and wherein the input signals are not transmitted to the control module unless the deadman switch is depressed.

3. The system of claim 2, wherein the docking station of the joystick assembly comprises a sloped slot shaped to receive and depress the deadman switch while the detachable base is coupled to the docking station.

4. The system of claim 3, wherein the deadman switch is biased by a spring into a non-depressed state.

5. The system of claim 2, wherein the detachable base of the joystick assembly further comprises an indicator that provides a first indication in response to the wireless transmitter being operational and the deadman switch being depressed.

6. The system of claim 5, wherein the indicator provides a second, different indication in response to the wireless transmitter not being operational or the deadman switch not being depressed.

7. The system of claim 1, wherein the detachable base of the joystick assembly further comprises a directional sensor in communication with the wireless transmitter; and wherein the directional sensor determines an orientation of the detachable base, and the wireless transmitter sends the orientation of the detachable base to the control module for comparison with an orientation of the vessel.

8. The system of claim 1, wherein the detachable base of the joystick assembly includes a rechargeable battery; and wherein the rechargeable battery is connected to a power supply via the first and second electrical connectors upon coupling of the detachable base with the docking station.

9. The system of claim 1, wherein the control module ignores data from the wireless receiver when the detachable base is coupled to the docking station and the second electrical connector is mated with the first electrical connector.

10. The system of claim 1, wherein the joystick assembly comprises the only joystick configured to communicate with the control module.

11. The system of claim 1, wherein the wireless receiver is mounted in the docking station of the joystick assembly.

12. A joystick assembly for generating and sending input signals to a control module that controls steering and thrust of a marine propulsion device on a marine vessel, the joystick assembly comprising:

a docking station configured to be coupled to a helm of the vessel;

a first electrical connector mounted in the docking station and connected to the control module by at least one cable;

a detachable base configured to couple with the docking station;

a handle supported by the detachable base and moveable with respect to the detachable base to generate the input signals;

a second electrical connector, complementary to the first electrical connector, mounted in the detachable base;

a wireless transmitter mounted in the detachable base; and a wireless receiver mounted in the docking station and in signal communication with the wireless transmitter and with the control module;

wherein, in response to the second electrical connector being mated with the first electrical connector when the detachable base is coupled to the docking station, the input signals are transmitted to the control module via the at least one cable; and wherein, in response to the second electrical connector being disconnected from the first electrical connector when the detachable base is removed from the docking station, the input signals are transmitted to the control module via the wireless transmitter and the wireless receiver.

13. The joystick assembly of claim 12, wherein the detachable base further comprises a deadman switch, and wherein the control module ignores the input signals unless the deadman switch is depressed.

14. The joystick assembly of claim 13, wherein the docking station comprises a sloped slot shaped to receive and depress the deadman switch while the detachable base is coupled to the docking station.

15. The joystick assembly of claim 14, wherein the deadman switch is biased by a spring into a non-depressed state.

16. The joystick assembly of claim 13, wherein the detachable base further comprises an indicator that provides a first indication in response to the wireless transmitter being operational and the deadman switch being depressed.

17. The joystick assembly of claim 16, wherein the indicator provides a second, different indication in response to the wireless transmitter not being operational and the deadman switch not being depressed.

18. The joystick assembly of claim 12, wherein the detachable base further comprises a directional sensor in communication with the wireless transmitter; and wherein the directional sensor determines an orientation of the detachable base, and the wireless transmitter sends the orientation of the detachable base to the control module for comparison with an orientation of the vessel.

19. The joystick assembly of claim 12, wherein the detachable base includes a rechargeable battery; and wherein the rechargeable battery is connected to a power supply via the first and second electrical connectors upon coupling of the detachable base with the docking station.

20. The joystick assembly of claim 12, wherein the control module ignores data from the wireless receiver when the detachable base is coupled to the docking station and the second electrical connector is mated with the first electrical connector.

* * * * *